US005551450A

United States Patent [19]

Hemsley

[11] Patent Number: 5,551,450

[45] Date of Patent: Sep. 3, 1996

[54] SMOKING PRODUCTS

[75] Inventor: Stephen R. Hemsley, Romsey, United Kingdom

[73] Assignee: Brown & Williamson Tobacco Corporation, Louisville, Ky.

[21] Appl. No.: 306,926

[22] Filed: Sep. 16, 1994

Related U.S. Application Data

[63] Continuation of Ser. No. 992,960, Dec. 18, 1992, abandoned.

[30] Foreign Application Priority Data

Dec. 18, 1991 [GB] United Kingdom ..... 9126828.4

[51] Int. Cl.[6] ..... A24B 15/00

[52] U.S. Cl. ..... 131/359; 131/369; 131/375

[58] Field of Search ..... 131/359, 369, 131/375

[56] References Cited

U.S. PATENT DOCUMENTS

| | | | |
|---|---|---|---|
| 4,379,464 | 4/1983 | Wu et al. | 131/275 |
| 4,510,950 | 4/1985 | Keritsis et al. | 131/353 |
| 4,821,749 | 4/1989 | Toft et al. | 131/375 |
| 4,823,817 | 4/1989 | Luke et al. | 131/375 |
| 4,977,908 | 12/1990 | Luke et al. | 131/375 |
| 5,072,744 | 12/1991 | Luke et al. | 131/375 |

*Primary Examiner*—Samuel Barts
*Attorney, Agent, or Firm*—Charles I. Sherman

[57] ABSTRACT

In a method of making a smoking product a mixture comprising a particulate bulk material, tobacco for example, a binder, sugar, ammonia and an ammonium salt, preferably with the addition of water, is extruded to provide a coherent extrudate.

15 Claims, 1 Drawing Sheet

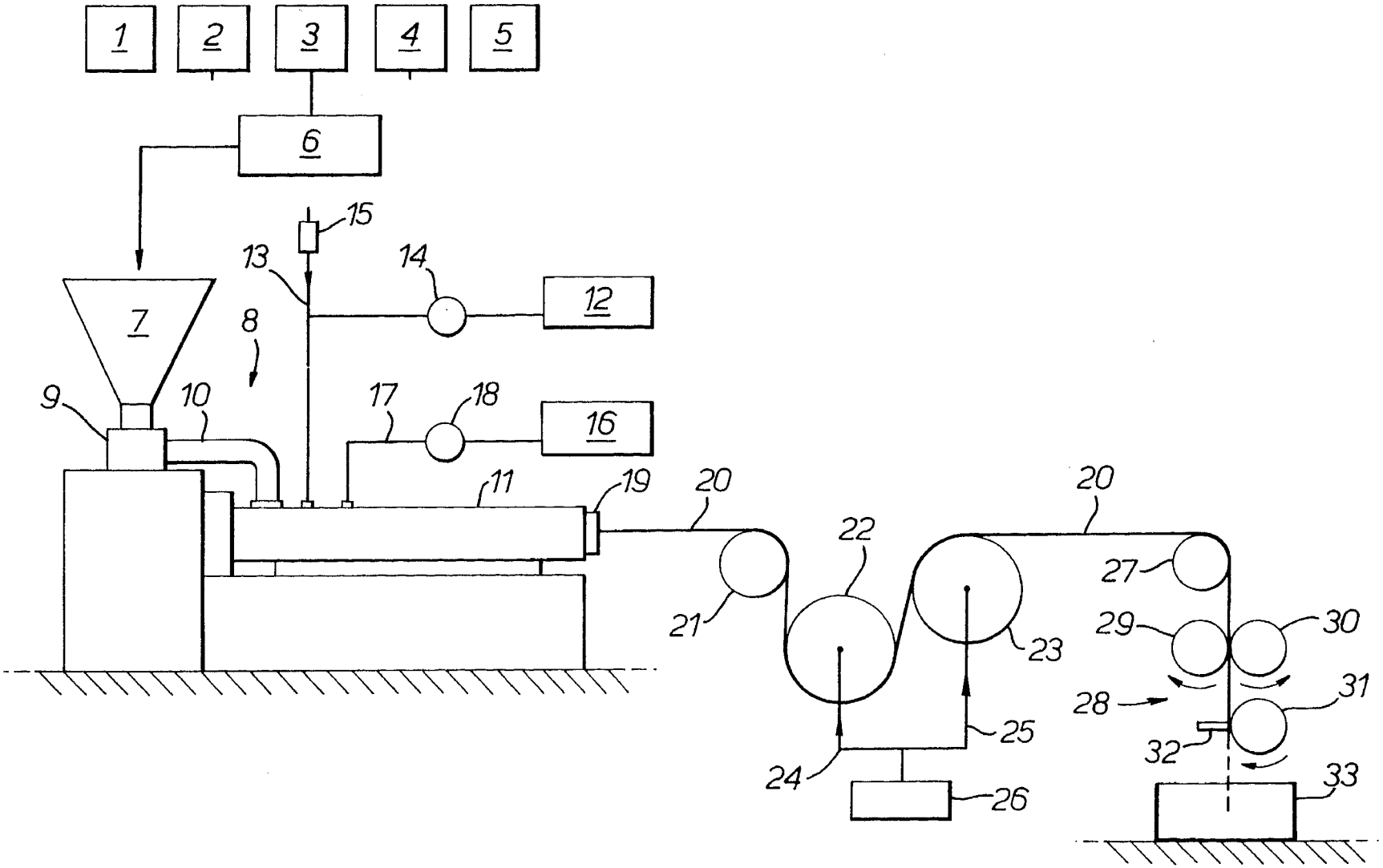
1
2
3
4
5
6
7
8
9
10
11
12
13
14
15
16
17
18
19
20
21
22
23
24
25
26
27
28
29
30
31
32
33

SMOKING PRODUCTS

This is a continuation of prior application Ser. No. 07/992,960 filed on Dec. 18, 1992, now abandoned which claims priority under 35 U.S.C. §119 of application Ser. No. 9126828.4 filed on Dec. 18, 1991 in the United Kingdom.

The subject invention relates to the making of smoking products by extrusion.

An object of the subject invention is to provide smoking products the smoke of which is of enhanced sensory character.

A further object of the subject invention is to provide a commercially practical method of making improved smoking products.

A yet further object of the subject invention is to provide an inherently low effluent method of making improved smoking products.

Processes for the making of smoking products by extrusion are disclosed in European Patent Publications Nos. 113 595 and 325 476, and in United Kingdom Patent Specification No. 2 201 080.

The subject invention provides a method of making a smoking product, wherein a mixture comprising particulate bulk material, a binder, sugar, ammonia and an ammonium salt is extruded by an extruder to provide a coherent extrudate.

Preferably, the bulk material comprises particulate tobacco. In such case, the mean particle size of the tobacco suitably does not exceed about 350 μm. Suitably, the tobacco comprises Burley tobacco. By preference the tobacco is not tobacco which has been subjected to an extraction process, such for example as a water extraction process.

The binder may, for example, be a cellulosic binder or an alginic binder. The binder is desirably a cellulosic binder. Suitable cellulosic binders are hydroxypropyl cellulose (HPC), e.g. Klucel (Trade Mark), and sodium carboxymethyl cellulose. A preferred binder is one being or including HPC.

The sugar in the above mentioned mixture is a reducing sugar or is or includes a sugar which, under the processing conditions of a method according to the subject invention, breaks down to give a reducing sugar or sugars. If the bulk material in the mixture comprises tobacco, the sugar of the said mixture may consist of or include sugar in the tobacco. If, however, the tobacco is Burley tobacco, or the greater proportion is Burley tobacco, it will generally be necessary to include extraneous reducing sugar in the mixture.

The reducing sugar, or a part thereof, may be replaced by a non-sugar reducing substance comprising a carbonyl group, so long as there occur within the extruder and/or the extrudate Maillard reactions involving the substance together with the ammonium salt and the ammonia.

Conveniently, the ammonia is fed to the extruder as aqueous ammonia.

The ammonium salt can be an organic or an inorganic ammonium salt. A suitable ammonium salt in order to react with the invert sugar to produce flavor components for the purposes of the subject invention is diammonium hydrogen orthophosphate (DAP).

The above mentioned mixture may also comprise a starch or a modified starch.

The bulk material may comprise a particulate filler, calcium carbonate for example.

A casing substance, licorice or cocoa for example, may be included in the mixture.

There may be fed to the extruder, or otherwise added to the mixture, a humectant, glycerol for example.

Suitably, water is fed to the extruder, or otherwise added to the mixture.

If the aforementioned mixture comprises tobacco, the method of the subject invention is suitably carried out so that there results little reduction, and preferably no, or substantially no, reduction, in the nicotine content of the tobacco.

The method is desirably carried out such that the extrudate expands upon emergence from the extruder die. If the method is so carried out, the extrudate may be subjected to draw down so as to effect a reduction in a cross-sectional dimension of the extrudate.

The extrudate is preferably of web or sheet form, although the extrudate can be of other form, e.g. rod form.

Tobacco may be present in the mixture within a range of 0% to 85% by weight, or more. Preferably, tobacco is present in the mixture at a level of at least about 50% by weight, and more preferably at a level of at least about 75% by weight.

The binder is suitably present in the mixture within a range of about 3% to about 10% by weight.

Extraneous sugar can be present in the mixture at up to about 5% by weight.

The ammonia, as aqueous ammonia, is suitably present within a range of about 0.5 to 3%, and more preferably within a range of about 1.5 to 2.5% by weight.

The ammonium salt is suitably present in the mixture within a range of about 2% to about 7%, and more preferably within a range of about 4% to about 5.5% by weight. Advantageously, the ammonium salt is present at a level two or more times the level at which the ammonium is present.

Starch may be present in the mixture within a range of 0% to about 15%.

A filler may be present in the mixture within a range of 0% to about 85% by weight. It is appropriate for a filler to be present within the mixture if the level of tobacco therein is low, e.g. 5% or less.

Water may be fed to the extruder such that the total water is within a range, on a wet weight basis, of about 15% to about 50%, and more preferably about 20% to about 35%.

Humectant may be present within a range of 0% to about 6% preferably within a range of about 2% to about 4%.

By preference, Maillard reactions between components of the mixture take place only in the extruder and in the extrudate.

Conveniently, the extruder used for the purposes of the subject invention is a single or twin screw cooker extruder which is operable to subject the mixture to mechanical working such as to generate heat within the mixture.

BRIEF DESCRIPTION OF THE DRAWING

In order that the present invention may be clearly understood and readily carried into effect, reference will now be made, by way of example, to the drawing hereof, which shows a schematic of an apparatus for making a smoking product.

In operation of the apparatus shown in the drawing to make a reconstituted tobacco product, particulate tobacco, starch, cellulosic binder, diammonium hydrogen phosphate and sugar are fed respectively from bins 1–5 to a mixer unit 6. The resultant mixture is fed to a hopper 7 of a twin screw cooker extruder generally designated by reference numeral 8. A feed unit 9 of the extruder 8 serves to feed the mixture through a feed pipe 10 to the inlet end of barrel 11 of the extruder 8. Ammonium hydroxide drawn from a tank 12 is fed into a pressurised water feed line 13 under the action of a pump 14. A check valve 15 prevents ammonium hydroxide being pumped up the line 13. The water and ammonium hydroxide are injected via line 13 into the barrel 11. Glycerol drawn from a tank 16 is injected into the barrel 11 through a line 17 under the action of a pump 18.

The barrel 11 is provided with heating and cooling means (not depicted) by the operation of which a desired temperature profile can be maintained along the barrel 11. At operational equilibrium conditions the temperature of the die (designated 19) is suitably maintained at 135° C.

Preferably, the pressure within barrel 11 is maintained at a value sufficient to ensure that water therein remains in the liquid phase. The pressure may be in a range of 3400kPa to 13600kPa.

As the coherent sheet form extrudate (designated 20) issues from the die 19, water in the extrudate 20 flashes off to steam, as a result of which the cross-section of the extrudate 20 becomes greater than the cross-section of the orifice of the die 19 and there is imparted to the extrudate 20 a substantially closed-cell cellular interior structure.

The extrudate 20 is passed about a plain, undriven cylindrical roller 21 and then about two plain, driven cylindrical rollers 22 and 23. Chilled water is circulated through the rollers 22,23 via lines 24,25 from a chilling and pumping unit 26. The extrudate 20 adheres to the rollers 22,23, so that the rollers, which are driven at a peripheral velocity in excess of the linear velocity of the extrudate 20 at exit from the die 19, exert a tractive force on the extrudate 20 and draw down the extrudate 20. The draw down ratio may be, for example, four to five.

Chilled water may, optionally, be circulated through the roller 21.

Downstream of the roller 23 the sheet form extrudate passes about guide roller 27 before entering a cutter unit 28. Upon entering the cutter unit 28 the extrudate passes between slitters 29 and 30 which serve to slit the extrudate into continuous filaments of a width of, for example, 0.8mm. The filaments then pass between a multi-bladed rotary cylinder 31 and a stationary blade 32, whereby the continuous filaments are severed to provide discrete filaments of a length of, for example, 40mm, which discrete filaments are collected in a container 33.

The smoking product collected in the container 33 is eminently suitable for blending with cut tobacco leaf cigarette filler and endows a cigarette utilising such blend with an enhanced sensory character.

A preferred mixture formulation, on a dry weight basis, of particulate materials which may be fed to the extruder is as follows:

| | |
|---|---|
| Tobacco | 80% |
| Starch | 10.7% |
| HPC | 3.7% |
| DAP | 5.3% |
| Invert Sugar | 1.3% |

Ammonium hydroxide is fed to the extruder barrel 11 at a rate which results in 5% ammonium hydroxide being present within the mixture, on a wet weight basis. Water is fed to the barrel 11 at a rate which results in 30% of total water, on a wet weight basis, being present in the mixture. Glycerol is fed to the barrel 11 at a rate which results in 2.5 to 3.0% glycerol, on a wet weight basis, being present in the mixture.

The tobacco in such formulation can be a blend, of dust constitution, of waste tobacco materials.

When smoking product made using the above mixture formulation was blended with conventional cigarette filler material and the blend was used in making cigarettes, it was observed that the mainstream smoke of the cigarettes was of enhanced sensory character.

I claim:

1. A method of making a smoking product comprising the steps of:

mixing particulate material, including tobacco, with a binder, sugar, or portion thereof replaced with a non-sugar reducing substance and an ammonium salt to form a mixture;

adding said mixture to an extruder and simultaneously therewith adding aqueous ammonia and water to said extruder; and, extruding said mixture and said aqueous ammonia and water at a temperature and pressure such that said water remains in a liquid phase.

2. The method according to claim 1 wherein said sugar or a portion thereof, may be a non-sugar reducing substance comprising a carbonyl group.

3. The method according to claim 1, wherein said binder is a cellulosic binder.

4. The method of claim 1, wherein said mixture may include a starch or modified starch.

5. The method according to claim 1, wherein said ammonia as aqueous ammonia, is present in said mixture within a range of 0.5% to 3% by weight.

6. The method according to claim 1, wherein said ammonium salt is present in said mixture within a range of 2% to 7% by weight.

7. The method according to claim 1, wherein said ammonium salt is present in said mixture at a level of two or more times the level, by weight, of said aqueous ammonia.

8. The method according to claim 1, wherein said ammonium salt is diammonium hydrogen orthophosphate.

9. The method according to claim 1, wherein said mixture may include a humectant up to to 6% of total weight of said particulate material.

10. The method according to claim 1, wherein said tobacco is present in said mixture within a range of at least 50% by weight.

11. The method according to claim 1, wherein said binder is present in said mixture within a range of 3% to 10% by weight.

12. The method according to claim 1, wherein said starch or modified starch is present in said mixture up to 15% of total weight of said mixture.

13. The method according to claim 1, wherein said water is present in said mixture within a range of about 15% to 50% wet basis.

14. The method according to claim 1, wherein said sugar or non-sugar reducing substance comprising a carbonyl group may be present in said mixture within a range of up to 5% by weight.

15. A method of making extruded tobacco comprising:

mixing particulate material in an extruder, said particulate material including at least 50% by weight tobacco, a cellulosic binder present within a range of 3% to 10% by weight, a sugar or non-sugar reducing substance present in the mixture at levels up to 5% by weight, and diammonium hydrogen orthophosphate present in said mixture within a range of 2% to 7% by weight;

injecting into said extruder containing said particulate material aqueous ammonia present in said mixture within a range of 0.5% to 3% by weight and water which is present in said mixture within a range of 15% to 50% by weight;

mixing said mixture in said extruder and maintaining in said extruder a pressure within a range of 340kPA to 13600kPA such that said water remains in the liquid phase; and, extruding said mixture through a die to form a coherent sheet.

* * * * *